US006493882B1

(12) United States Patent
Steele et al.

(10) Patent No.: US 6,493,882 B1
(45) Date of Patent: Dec. 17, 2002

(54) MIRROR ARRANGEMENT FOR A REAR VIEW MIRROR SYSTEM IN AN ARTICLE OF HEADGEAR AND A MOUNTING SYSTEM THEREFOR

(75) Inventors: Graham Steele, Newcastle-upon-Tyne; Andrew W. Campbell, Middlesborough, both of (GB)

(73) Assignee: Reevu Limited, Wolsingham (GB)

( * ) Notice: Subject to any disclaimer, the term of this patent is extended or adjusted under 35 U.S.C. 154(b) by 0 days.

(21) Appl. No.: 09/744,067

(22) PCT Filed: Jul. 19, 1999

(86) PCT No.: PCT/GB99/02312

§ 371 (c)(1),
(2), (4) Date: Jun. 4, 2001

(87) PCT Pub. No.: WO00/03613

PCT Pub. Date: Jan. 27, 2000

(30) Foreign Application Priority Data

Jul. 18, 1998 (GB) ..... 9815614

(51) Int. Cl.[7] ..... A42B 1/24

(52) U.S. Cl. ..... 2/422; 359/859; 359/861; 359/880

(58) Field of Search ..... 2/422, 424, 425, 2/DIG. 8, 410; 359/880, 861, 859

(56) References Cited

U.S. PATENT DOCUMENTS 2,221,449 A * 11/1940 Hoeninghausen
3,594,069 A * 7/1971 Harvey
3,804,495 A * 4/1974 Rayow et al.
3,978,526 A * 9/1976 Mitchell et al.
4,722,101 A * 2/1988 Blower
5,559,640 A * 9/1996 Vachss et al.
5,771,497 A * 6/1998 Steele

* cited by examiner

*Primary Examiner*—Rodney M. Lindsey
(74) *Attorney, Agent, or Firm*—Woodard, Emhardt, Naughton, Moriarty & McNett

(57) ABSTRACT

A mirror arrangement (10) for a rear view mirror system comprises three mirrors (14, 16, 18). The first mirror (14) is a concave off-axis parabolic mirror arranged adjacent the eyes of the user with a principal axis and effective focal length $f_1$. The second mirror (16) is substantially flat and is arranged between the first and third mirrors (14, 18). The third mirror (18) is a convex off axis parabolic mirror having a principal axis under an effective focal $f_3$. The first and third mirrors (14, 18) have a common focus and the parabolas of the first and third mirrors (14, 18) are related such that $1.5 f_1 \leqq f_3 \leqq 3f_1$. In another aspect of the invention a mounting arrangement (24) for a rear view mirror system comprises an article of headgear (12) with a channel (20) formed therein and a mirror assembly mounted on the article of headgear so as to bridge the channel. The mirror assembly has series of lugs (26) protruding from the longitudinal edges thereof. The article of headgear has a series of recesses (28) arranged to receive the lugs (26) on the mirror assembly arranged along both edges of the channel (20).

16 Claims, 2 Drawing Sheets

MIRROR ARRANGEMENT FOR A REAR VIEW MIRROR SYSTEM IN AN ARTICLE OF HEADGEAR AND A MOUNTING SYSTEM THEREFOR

The present invention relates to a mirror arrangement for a rear view mirror system in an article of headgear, especially for a rear view mirror system in a cycling or motorcycling helmet, although not exclusively limited thereto.

Rear view mirror systems for cycling and motorcycling helmets are known, such as the helmet shown in PCT/GB94/00485 which relates to a helmet having a solid block of light transmissive material with reflective surfaces arranged within a channel in the foam padding of a helmet. FR2631789 discloses a helmet with an open, hollow channel through the helmet over the wearer's head. The helmet has two mirrors on the upper side of the channel and one mirror on the lower side of the channel. The mirrors direct light from behind the wearer to the wearer's eyes. EP0007432 discloses a helmet including a series of convex lenses and an optical fibre in the helmet to enable the wearer to see behind themselves. Three of the lenses are arranged radially to the wearer's head. The channel through the helmet is hollow and open to the air. A further helmet is known from PCT/GB96/02349 where a plurality of mirrors are arranged on a one piece mounting which is arranged in a channel in the foam padding inside the outer shell of the helmet.

The region of distinct vision of the retina of the human eye occupies approximately 6° in terms of plane angles. In other words, without moving the eye, only objects lying in a cone of vertex angle 6° can be distinguished clearly. It is an object of the present invention to provide an improved mirror arrangement for a rear view mirror system in an article of headgear.

According to one aspect of the invention there is provided a mirror arrangement for a rear view mirror system in an article of headgear comprising first, second and third mirrors, the first mirror comprising a concave, off axis parabolic mirror arranged, in use, adjacent the eyes of the user, the first mirror having a principal axis and an effective focal length $f_1$, the second mirror being substantially flat and being arranged between the first and the third mirror and the third mirror comprising a convex, off axis parabolic mirror having a principal axis and an effective focal length $f_3$, whereby the first and third mirrors have a common focus and the parabolas are related such that $1.5\ f_1 \leq f_3 \leq 3f_1$.

In that way, the mirror arrangement of the invention allows an expanded field of view to be viewed in a contact mirror arrangement which can be located in a channel in the foam padding of the helmet without compromising the protective function thereof. The claimed range of parabola geometry provides a range of field of view from 9 to 18°. Preferably, $f_3 = 2f_1$ In that way, the mirror arrangement in the helmet doubles the field of vision, in other words, the field of vision is approximately 12°. That enables a 2 metre high object to be viewed in full at a distance of 10 metres behind the user.

The second flat mirror is preferably arranged closer to the first mirror than the third mirror. That arrangement is to allow the size of the second mirror to be reduced and to increase the angle of light approach $\phi$ at the third mirror.

The first mirror is preferably arranged, in use, so that it can be viewed by both eyes of the user.

The mirrors are preferably arranged in a channel in the foam padding of a helmet. The mirrors are preferably all arranged across the top of the channel facing into the channel.

The mirrors may be formed as part of a one piece mounting. The one piece mounting may be arranged in the aforesaid channel. Preferably the one piece mounting comprises a mating formation on an edge thereof and the article of headgear includes a channel, the article of headgear having a co-operating mating formation formed along an edge of the channel, the mating formation co-operating so as to retain the mirror arrangement on the article of headgear.

According to another aspect of the invention there is provided a mounting arrangement for a rear view mirror system, the arrangement comprising an article of headgear having a channel formed therein and a mirror assembly mounted on the article of headgear so as to bridge the channel, the mirror assembly having a mating formation formed along an edge thereof, the article of headgear having a co-operating mating formation formed along an edge of the channel, the mating formations co-operating so as to retain the mirror assembly of the article of headgear. That provides a convenient way of assembling the mirror assembly into the article of headgear.

Preferably, the mirror assembly has respective mating formations formed along opposite edges thereof and the article of headgear has respective co-operating mating formations formed along opposite edges of the channel. The mating formation on the mirror assembly or article of headgear may comprise at least one protrusion and the mating formation on the other of the mirror assembly and article of headgear may comprise at least one recess, the or each protrusion fitting within the respective recess with an interference fit. In a preferred embodiment the protrusion is provided on the mirror assembly and the recess is provided on the edge of the channel in the article of headgear.

Preferably, the protrusion comprises a lug having a neck and a head, the head being larger than the neck, the recess being substantially the negative of the protrusion. The lug may be formed with a curve between the neck and the head.

In that way impact or stress to the article of headgear is dissipated through the mirror assembly via the curved lugs into the body of the article of headgear. The curved lugs reduce stress concentrations and thus reduce the risk of the mirror assembly breaking under stresses applied to the article of headgear. In the case of a helmet, impacts may be severe and the configuration of the mounting renders the mirror assembly safer than previous such systems.

Preferably, a plurality of protrusions and a corresponding plurality of recesses are provided. Most preferably a plurality of curved lug protrusions and respective mating recesses are provided.

An embodiment of the invention will now be described in detail by way of example and with reference to the accompanying drawings in which.

Figure 1:
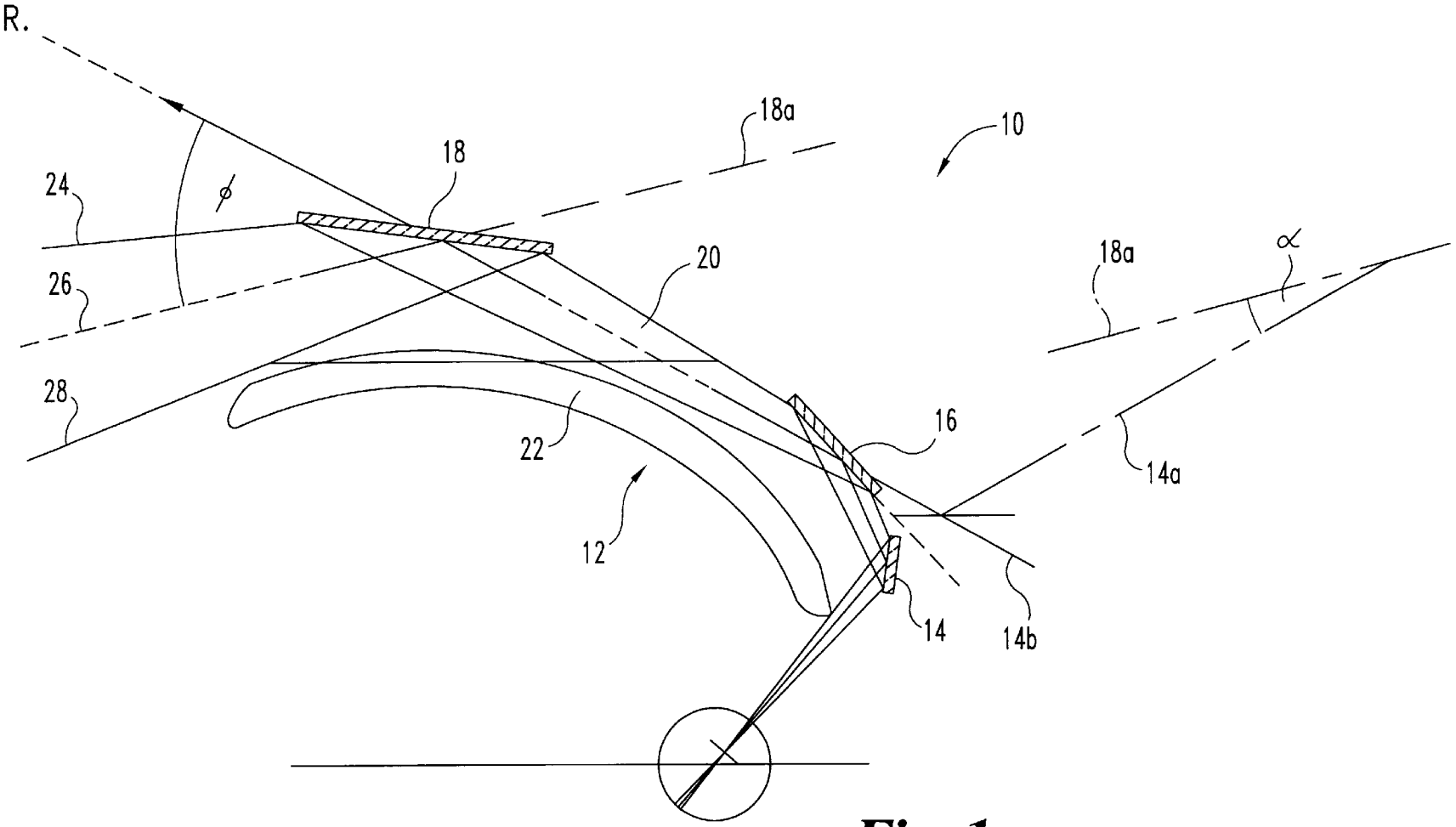
FIG. 1 is a schematic side elevation of a mirror arrangement in accordance with the invention.

A mirror arrangement 10 in accordance with the invention is arranged within an article of headgear 12, such as a motorcycle helmet. The mirror arrangement 10 comprises a first mirror 14, a second mirror 16 and a third mirror 18.

The mirror arrangement 10 is located in a channel 20 formed in foam padding 22 of the helmet 12, the channel extending across the top of the head of the wearer, in use, from adjacent the forehead of the user to adjacent the crown of the head of the user. The mirrors 14, 16, 18 are located on a mounting (not shown) which extends across the top of the channel 20 whereby all the mirrors face into the channel towards the floor of the channel.

The first mirror 14 comprises a concave off axis parabolic mirror. The mirror 14 is arranged in such a position that the wearer can view the mirror 14 with both eyes when wearing the article of headgear 12. Accordingly, the mirror 14 is wide enough to be viewed by both eyes and has a length of 10 to 20 mm, most preferably 16 mm.

The second mirror 16 is substantially flat and is located close to the first mirror. That enables the size of that mirror to be reduced which reduces the size of the front part of the mirror arrangement. Also, the provision of a substantially flat mirror redirects the incoming light rays so that the angle of light approach $\phi$ at the third mirror can be increased which improves the image quality. Also, the provision of the substantially flat mirror 16 reflects the light rays substantially downwardly into the first mirror as shown in FIG. 1 which reduces the amount that the first mirror must be spaced from the head of the user in order to reflect light rays into the eye of user. Also, the provision of an odd number of mirrors is required in order to provide an image which appears the correct way round. An even number of mirrors would provide an image which was reversed.

The third mirror 18 is a convex off axis parabolic mirror. The third mirror 18 is larger than the first and second mirrors and is arranged at the rear of the article of headgear above the crown of the head of the user.

The first mirror 14 has an effective axis 14*a* and the third mirror 18 has an effective axis 18*a*. A line parallel to 18*a* is indicated in FIG. 1 for the purposes of illustration. The angle between the axes 14*a* and 18*a* is shown as a. That angle is, in the case of FIG. 1, approximately 16*a*. The curved mirrors 14, 18 have a common effective focal point R shown in FIG. 1. That focal point R is spaced along the principal axis of the first mirror 14 as shown at 14*b* in FIG. 1. The positioning of the first and third mirrors and the geometry of the parabolas is determined according to the following equation $$1.5\ f1 < f3 < 3f1$$

where f1 is the effective focal length of the first mirror 14 and f3 is the effective focal length of the third mirror 18.

The orientation and location of the mirrors is determined by the geometry thereof. In particular, the geometry of the mirrors 14, 18 alters the position of the common focal point which, in turn, alters the change in the field of view that the mirror arrangement 10 in accordance with the present invention provides.

As mentioned previously, the human eye can distinguish clearly a vertex angle of 6°. Accordingly, light entering the eye from the first mirror 14 is only viewed clearly across an angle of 6° at the retina. Thus, in order to provide an effective rear view mirror arrangement, it is necessary to alter the field of view. The arrangement set out above increases the field of view to between 9° and 18°. In the particular arrangement set out in FIG. 1, it is intended that the field of view be 12°. In other words, f3=2f1.

Thus the geometry of the two parabolas is related. In the embodiment shown the common focal point R is spaced from the first mirror twice as far as it is spaced from the third mirror.

Obviously, selecting an alternative relationship between first and third mirrors within the aforesaid range will provide a different field of view. A field of view of 6°, i.e. where plane mirrors are used, is not sufficient for a rear view mirror system in a helmet.

In the present embodiment where the arrangement is intended to be used as a rear view mirror system for a motorcycle helmet, it is important that the wearer can see the vehicles behind him at a sufficiently short distance without having to move his head around. A field of view of 6°, as provided by plane mirrors, is not sufficient since a 2 metre high object can only be viewed completely when at least 30 metres behind a motorcycle rider, presuming the rider is approximately 1.5 metres tall when seated on his motorcycle. Increasing the field of view reduces the distance at which objects of that size can be viewed without moving the head. The only alternative is to provide a larger mirror arrangement which would compromise the integrity of the helmet. The present arrangement provides the advantage of a wide field of view in a compact mirror arrangement which does not compromise the primary function of the helmet, namely to protect the wearer.

Figure 2:
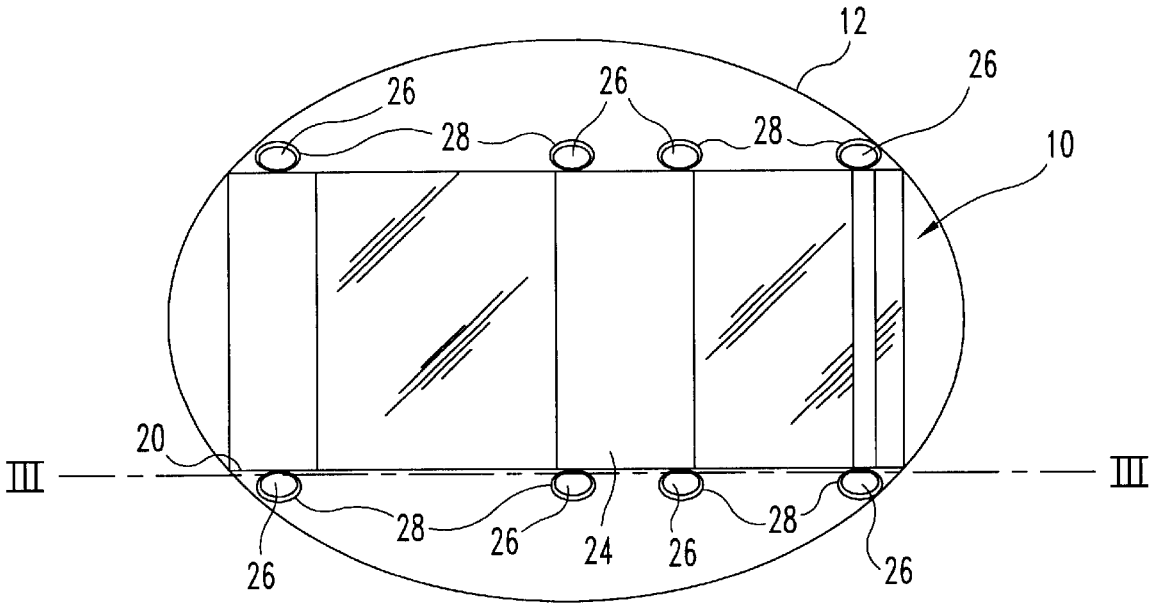
FIG. 2 is a plan view of a cycle helmet incorporating a mirror arrangement and mounting arrangement in accordance with the invention.
Figure 3:
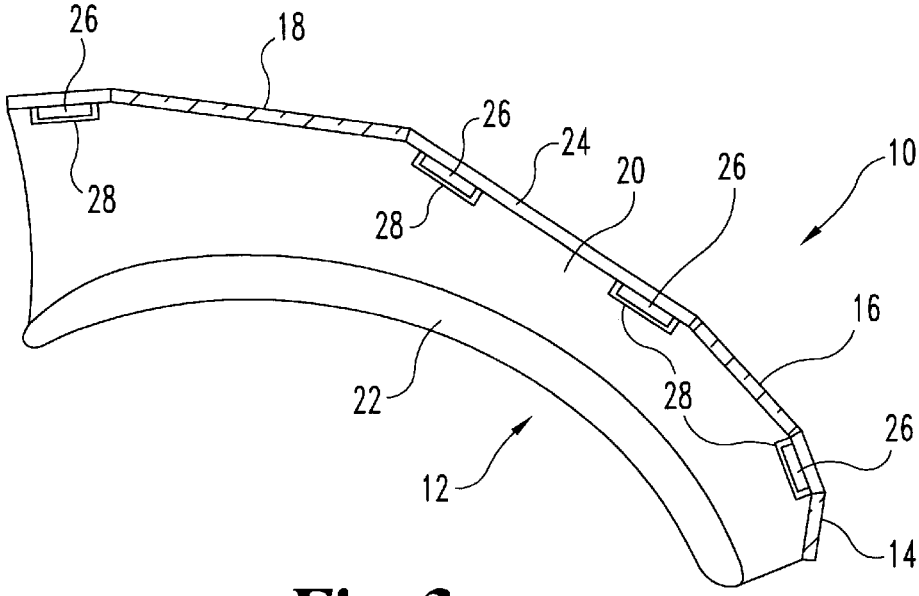
FIG. 3 is a cross section taken on line III—III in FIG. 2.

In FIG. 2 a cycle helmet 12 incorporates the mirror arrangement 10 of FIG. 1. Cycle helmet 12 includes a channel 20 formed in the padding of the helmet across the top of the helmet from the front to the back thereof. The mirror arrangement 10 comprises mirrors 14, 16, 18 as described above located on a mounting 24. The mounting 24 is elongate and includes four lug-like projections 26 spaced along each longitudinal edge thereof.

The padding 22 of the helmet 12 has four recesses 28 formed spaced apart along each edge of the channel 20. The recesses 28 are substantially the negative of the protrusions 26 on the mounting 24 so that the protrusions 26 are received within the recesses 28 with an interference fit. The lugs and recesses are similar to the lugs and recesses found on a jigsaw puzzle. Each lug 26 has a neck and an enlarged head, the neck curving outwardly into the head and the recesses 28 are formed in similar fashion.

In order to assemble the mounting 24 on to the helmet 12 the mounting is located across the top of the channel with the mirrors 14, 16, 18 facing into the channel. The lugs 26 are then pressed into the respective recesses 28 until they are properly received with an interference fit. Because of the narrowed neck and enlarged head of each lug 26. the lugs cannot be pulled out from the recesses 28 easily. The shell of the helmet is then located over the whole assembly so as to retain the mounting 24 in the channel 20. In the event of an impact on the helmet the shell initially serves to dissipate some of force but forces transmitted into the padding and, consequently, into the mounting 24. However, due to the curved design of the mounting lugs 26 and recesses 28 the stress is dissipated from the mounting into the padding 22 of the helmet without stress concentration. The curved design of the mounting lugs increases the wear resistance of the mirror arrangement and allows for secure and safe mounting of the mirror arrangement within the helmet 12.

What is claimed is:

1. A mirror arrangement for a rear view mirror system in an article of headgear comprising first, second and third mirrors, the first mirror comprising a concave, off axis parabolic mirror arranged, in use, adjacent the eyes of the user, the first mirror having a principal axis and an effective focal length $f_1$, the second mirror being substantially flat and being arranged between the first and the third mirror, the third mirror comprising a convex, off axis parabolic mirror having a principal axis and an effective focal length $f_3$, whereby the first and third mirrors have a common focus and the parabolas are related such that $1.5\ f_1 \leqq f_3 \leqq 3f_1$.

2. A mirror arrangement according to claim 1 in which $f_3 = 2f_1$.

3. A mirror arrangement according to claim 1 in which the second flat mirror is arranged closer to the first mirror than the third mirror.

4. A mirror arrangement according to claim 1 in which the first mirror is arranged, in use, so that it can be viewed by both eyes of the user.

5. A mirror arrangement according to claim 1 in which the article of headgear comprises a helmet, the helmet having foam padding therein, a channel being provided in the foam padding of the helmet, and the mirrors being arranged in the channel.

6. A mirror arrangement according to claim 5 in which the mirrors are all arranged across the top of the channel facing into the channel.

7. A mirror arrangement according to claim 1 in which the mirrors are formed as part of a one piece mounting.

8. A mirror arrangement according to claim 5 in which the mirrors are formed as part of a one piece mounting and the one piece mounting is arranged in the aforesaid channel.

9. A mirror arrangement according to claim 7 in which the one piece mounting comprises a mating formation on an edge thereof and the article of headgear includes a channel, the article of headgear having a co-operating mating formation formed along an edge of the channel, the mating formation co-operating so as to retain the mirror arrangement on the article of headgear.

10. A mounting arrangement for a rear view mirror system, the arrangement comprising an article of headgear having a channel formed therein and a mirror assembly mounted on the article of headgear so as to bridge the channel, the mirror assembly having a mating formation formed along an edge thereof, the article of headgear having a co-operating mating formation formed along an edge of the channel, the mating formations co-operating so as to retain the mirror assembly on the article of headgear.

11. A mounting arrangement according to claim 10 in which the mirror assembly has respective mating formations formed along opposite edges thereof and the article of headgear has respective co-operating mating formations formed along opposite edges of the channel.

12. A mounting arrangement according to claim 10 in which the mating formation on the mirror assembly or article of headgear comprises at least one protrusion and the mating formation on the other of the mirror assembly and article of headgear comprises at least one recess, the or each protrusion fitting within the respective recess with an interference fit.

13. A mounting arrangement according to claim 12 in which the protrusion is provided on the mirror assembly and the recess is provided on the edge of the channel in the article of headgear.

14. A mounting arrangement according to claim 12 in which the protrusion comprises a lug having a neck and a head, the head being larger than the neck, the recess being substantially the negative of the protrusion.

15. A mounting arrangement according to claim 14 in which the lug is formed with a curve between the neck and the head.

16. A mounting arrangement according to claim 12 in which a plurality of protrusions and a corresponding plurality of recesses are provided.

* * * * *